US006599103B2

(12) United States Patent
Finnamore et al.

(10) Patent No.: US 6,599,103 B2
(45) Date of Patent: Jul. 29, 2003

(54) LOCOMOTIVE AIR COMPRESSOR WITH OUTBOARD SUPPORT BEARING

(75) Inventors: Roger A. Finnamore, Quincy, IL (US); Timothy K. Heimonen, La Grange, MO (US)

(73) Assignee: Gardner Denver, Quincy, IL (US)

( * ) Notice: Subject to any disclaimer, the term of this patent is extended or adjusted under 35 U.S.C. 154(b) by 0 days.

(21) Appl. No.: 10/178,174

(22) Filed: Jun. 24, 2002

(65) Prior Publication Data

US 2002/0159896 A1 Oct. 31, 2002

Related U.S. Application Data

(63) Continuation-in-part of application No. 09/736,773, filed on Dec. 14, 2000.

(51) Int. Cl.[7] ..... F04B 17/00

(52) U.S. Cl. ..... 417/360; 417/415; 92/140; 384/585

(58) Field of Search ..... 417/360, 415; 92/140; 384/585, 584

(56) References Cited

U.S. PATENT DOCUMENTS 2,702,603 A * 2/1955 Risk et al. ..... 180/9.62
3,405,980 A * 10/1968 Stonebraker ..... 384/584
4,086,041 A * 4/1978 Takada ..... 418/84
4,248,050 A * 2/1981 Durenec ..... 62/6
4,632,639 A * 12/1986 Beaumont ..... 417/223
5,340,287 A * 8/1994 Kawahara et al. ..... 417/410.5
5,443,316 A * 8/1995 Deane et al. ..... 384/485
5,505,548 A * 4/1996 Stewart ..... 384/537
5,957,667 A * 9/1999 Epp ..... 417/271
6,078,118 A * 6/2000 Reinartz et al. ..... 310/89
6,129,455 A * 10/2000 Galante ..... 384/537
6,196,812 B1 * 3/2001 Siegel ..... 417/360
6,299,360 B1 * 10/2001 Dougherty et al. ..... 384/584

OTHER PUBLICATIONS

Non–locomotive air compressor sold in USA. (illustration)drawing dated Dec. 1968. Submitted with IDS in Ser. No. 09/736,773 on Dec. 14, 2000.*

Blow–Up of Drawing Submitted on Jun. 24, 2002 and on Dec. 12, 2000 in 09/736,773, dated Dec. 1968.

Technical drawing of non locomotive air–compressor sold in the United States, Dec. 1968.

* cited by examiner

*Primary Examiner*—Cheryl J. Tyler
*Assistant Examiner*—Michael K. Gray
(74) *Attorney, Agent, or Firm*—Robert F. I. Conte; Barnes & Thornburg

(57) ABSTRACT

This invention is directed to a locomotive air compressor that includes a detachable bearing housing that houses an outboard crankshaft bearing. The bearing housing includes a flange, a tapered housing and a bearing retainer. The housing also includes a central bore to allow for the passage of a crankshaft and an annular recess which supports the outboard crankshaft bearing. The addition of an outboard crankshaft support bearing allows the placement of the bearing closer to the electric motor, eliminating deflections that are inherent with extended, unsupported crankshafts. The elimination of crankshaft deflections allows the use of more efficient electric motors that have a smaller air gap between the rotor and the stator. The bearing housing is detachable to allow access to the bearings in the crankcase for easy servicing.

7 Claims, 5 Drawing Sheets

LOCOMOTIVE AIR COMPRESSOR WITH OUTBOARD SUPPORT BEARING

The present application is a Continuation In Part application of application Ser. No. 09/736,773, filed Dec. 14, 2000, now pending.

BACKGROUND OF THE INVENTION

This invention may be described as an improved reciprocating air compressor which is attached to an electric drive motor and provides for a high pressure air supply for locomotives and is designed to include a third crankshaft bearing that is contained in an extended bearing housing, which is detachable from the crankcase to decrease crankshaft deflection.

DESCRIPTION OF RELATED ART

It is known to use multi-cylinder air compressors on freight and passenger locomotives. The compressors supply compressed air to the operating and control equipment of a railway air brake system. Generally in a reciprocating compressor one or more pistons are connected to a crankshaft by use of connecting rods. As the crankshaft turns, the connecting rods reciprocate the pistons in cylinders causing the compression of air. Air compressors are designed so that the crankshaft is supported by a pair of main bearings located on opposite ends of the crankshaft. The crankshaft extends outwardly from the compressor crankcase and is connected to an integrated inline electric motor. With only two bearings supporting the crankshaft the extended length and the weight of the overhung rotor causes considerable deflection of the extended crankshaft thereby causing an non-uniform motor air gap. The non-uniform air gap generates an unbalanced magnetic pull during the start up of the motor, which in turn increases the crankshaft deflection. This deflection can be large enough to cause rubbing between the rotor and the stator of the compressor drive motor. These deflections are exacerbated due to the length of the shaft connecting the compressor to the electric motor. To compensate for the movement of the rotor caused by deflections in the crankshaft, the air gap between the stator core and the rotor on the prior art devices is increased to prevent stator to rotor contact. This increased gap however, decreases the efficiency of the electric motor and does not always prevent rotor to stator rubbing.

SUMMARY OF THE INVENTION

This invention may be described as an air compressor for locomotives that allows for the direct attachment of an electric motor and provides for an extended crankcase housing that includes an outboard crankshaft bearing to eliminate deflections in the crankshaft and rotor. The elimination of deflections in the crankshaft allows for a more uniform and reduced air gap between the stator and the rotor of the electric motor, increasing the motor's efficiency and eliminating the opportunity of rotor to stator contact. The electric motor is adapted to allow the extended crankcase housing to fit within the rotor of the motor, placing the outboard crankshaft support bearing closer to the rotor than conventional designs and significantly reducing the overall overhang of the crankshaft. The outboard crankshaft support bearing is enclosed in an extended bearing housing that is removable from the crankcase to facilitate maintenance. A shorter crankshaft overhang has less deflection, reducing unwanted rotor movement. The locomotive air compressor includes a crankcase with three reciprocating pistons connected to a common crankshaft. The crankshaft is supported by two main bearings on opposite sides of the crankcase. The air compressor also includes the removable extended bearing housing that includes the outboard crankshaft support bearing to prevent crankshaft deflection. The extended crankshaft housing is adapted to accept an integrated electric motor. The electric motor rotor is adapted to be connected to the crankshaft. The extended housing of the outboard bearing provides for a more rigid support structure for the motor rotor, which reduces the length of the overhung shaft to reduce crankshaft deflection. Also the side load created by the unbalanced magnetic pull by the electric motor is transferred to the extended bearing housing which further prevents unwanted movement. Since the outboard bearing is fluidly connected to the compressor crankcase, lubricating oil can adequately be fed to and returned from the bearing, eliminating the need for a separate bearing oiling system.

DETAILED DESCRIPTION OF THE INVENTION

While the present invention will be described fully hereinafter with reference to the accompanying drawings, in which a particular embodiment is shown, it is understood at the outset that persons skilled in the art may modify the invention herein described while still achieving the desired result of this invention. Accordingly, the description which follows is to be understood as a broad informative disclosure directed to persons skilled in the appropriate arts and not as limitations of the present invention.

Figure 1:
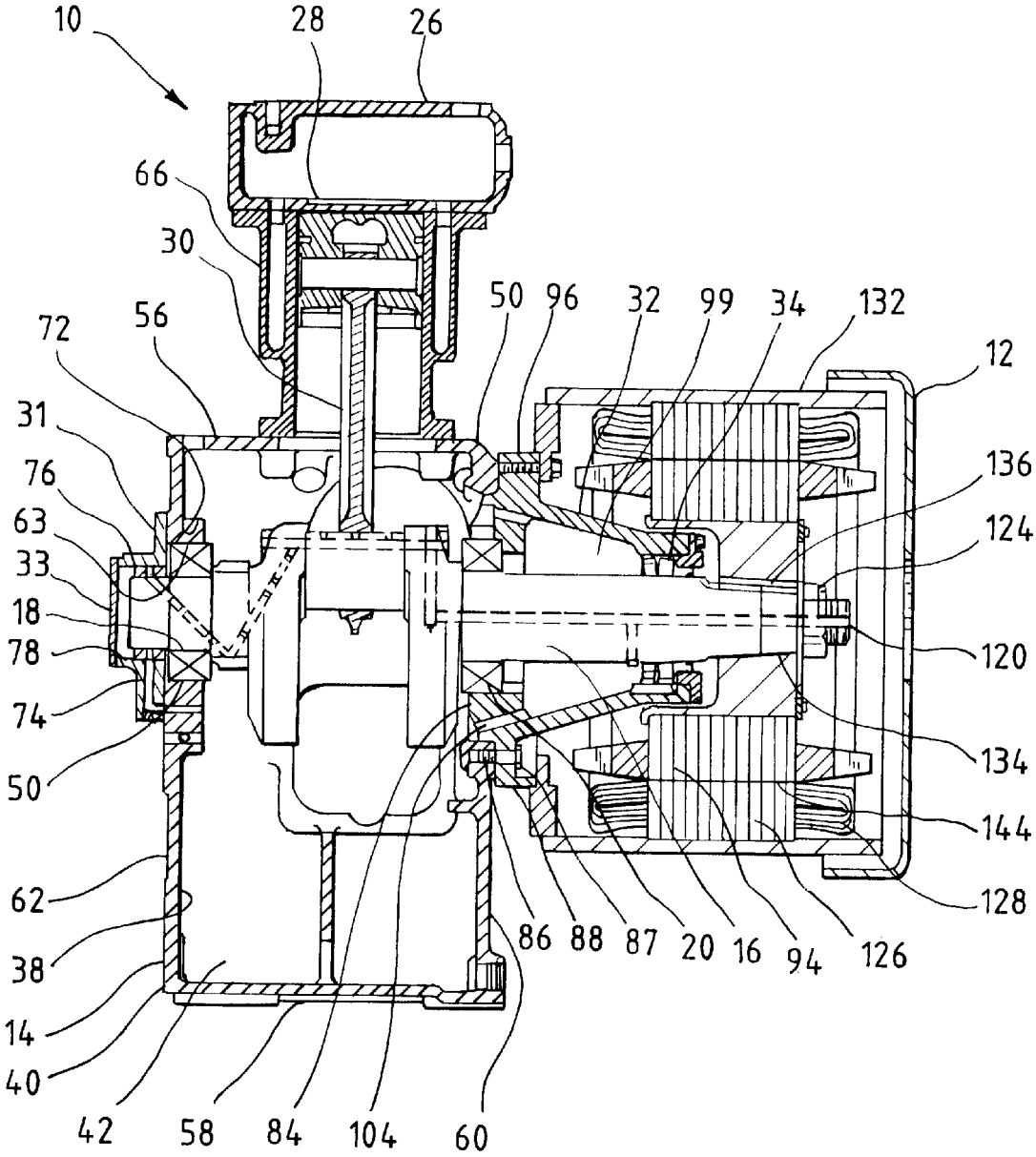
FIG. 1 is a cross-sectional view of the compressor with the extended bearing housing and the integrated motor.

A preferred embodiment of the locomotive air compressor 10 of the present invention is shown in FIG. 1. The compressor 10 is attached to an integrated electric motor 12. The air compressor 10 is adapted to be used in a locomotive to provide a continuous high pressure air supply for pneumatic braking systems. The compressor 10 includes a crankcase 14, which houses the crankshaft 16 and the first and second main bearings 18 and 20. The compressor also includes three cylinders 22, 24, 26, shown best in FIG. 3, in a "W" configuration with pistons 28, connecting rods 30 and in FIG. 1, an extended bearing housing 32, and an outboard crankshaft bearing 34. The air compressor 10 allows for disassembly of the extended bearing housing 32 to allow access to the main bearing 20 without complete disassembly of the compressor 10. The crankcase 14 is rectangular in shape and is adapted to be fastened to a railroad locomotive with flanges 36, shown in FIG. 2. The crankcase has an inside surface 38 and an outside surface 40, shown in FIG. 3. The inside surface 38 includes an oil sump 42, an oil pump 44, the crankshaft 16 and the connecting rods 30. The oil sump 42 holds oil used to lubricate the moving parts in the compressor 10. The pump 44 is a positive displacement type and includes a pickup tube 46. The pump 44 is gear driven by the compressor crankshaft 16 and provides pressurized lubrication under all operating conditions, including low speed. The oil is picked up from the sump 42 using the pickup tube 46 and it is pumped through an oil filter 48 before it is pumped to the moving parts of the compressor 10 such as the bearings 18, 20 and 34. The inside surface 38 also includes main bearing supports 50, shown in FIG. 1, to properly retain the main bearings 18 and 20 within the crankcase 14. The outside surface 40, shown in FIG. 3, includes an oil filter mount 52 for the attachment of the oil filter 48, a crankcase drain 54, the three cylinders 22, 24 and 26, a main bearing retainer 31, shown in FIG. 1, the extended bearing housing 32 and the integrated electric motor 12. The outside surface 40 has a top side 56, a planar bottom side 58, a front side 60 and a rear side 62. The top side 56 is adapted to allow for the attachment of the three cylinders 22, 24 and 26, shown in FIG. 3. The second cylinder (high pressure) 24 is mounted vertically and the first and third cylinders (low pressure) 22 and 26 are angled to form a W-configuration. The cylinders 22, 24 and 26 are slightly skewed to provide enough room to allow the respecting connecting rods 30 to converge at the crankshaft 16. The cylinders 22–26 may include cooling fins (not shown), if they are air cooled or water jackets 66, shown in FIG. 3 if they are water cooled. The cylinders 22–26 are bolted to the top side 56 and are sealed to prevent leaks.

Figure 2:
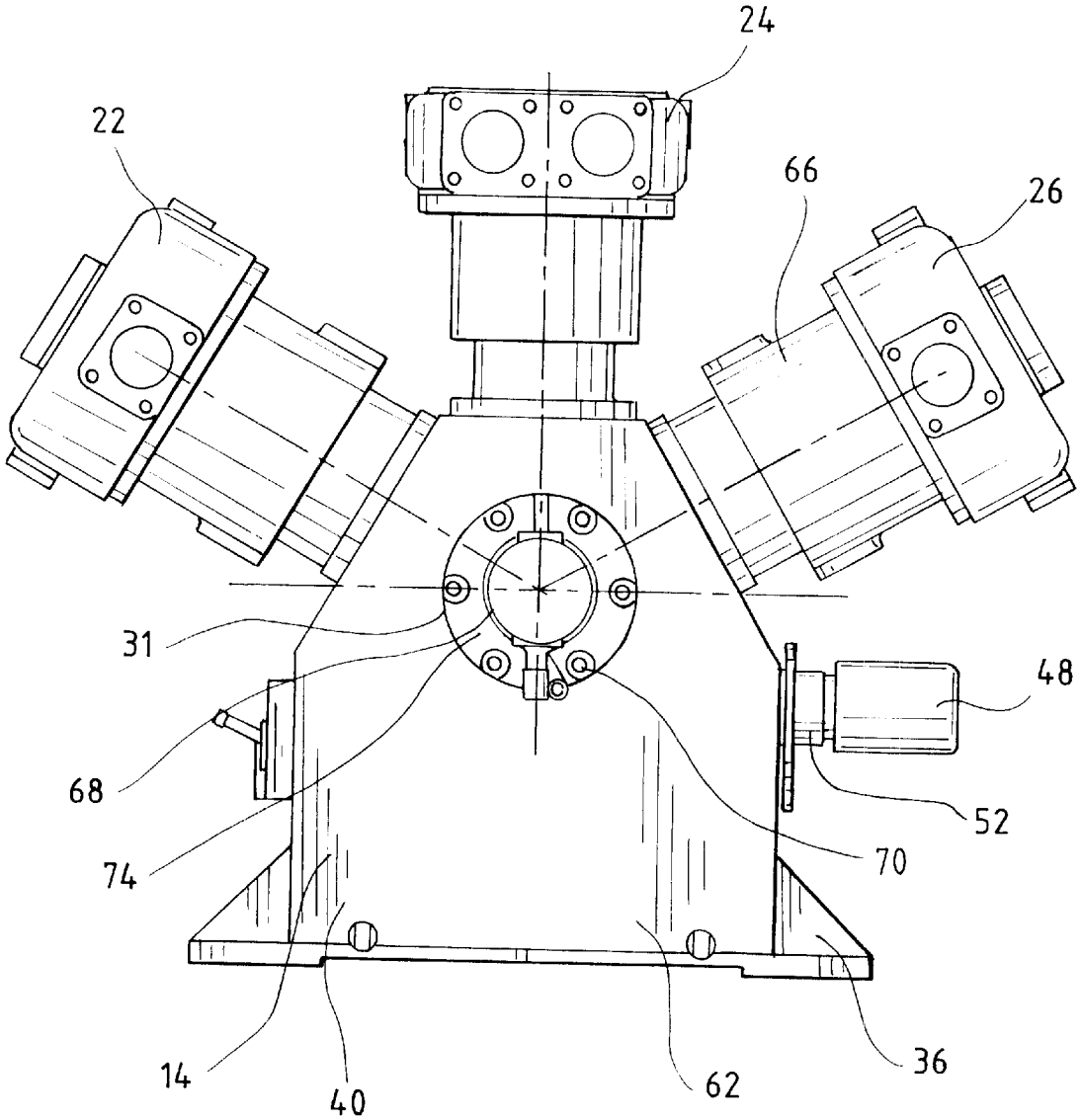
FIG. 2 is an opposite drive end plan view of the extended bearing housing attached to the compressor crankcase.
Figure 3:
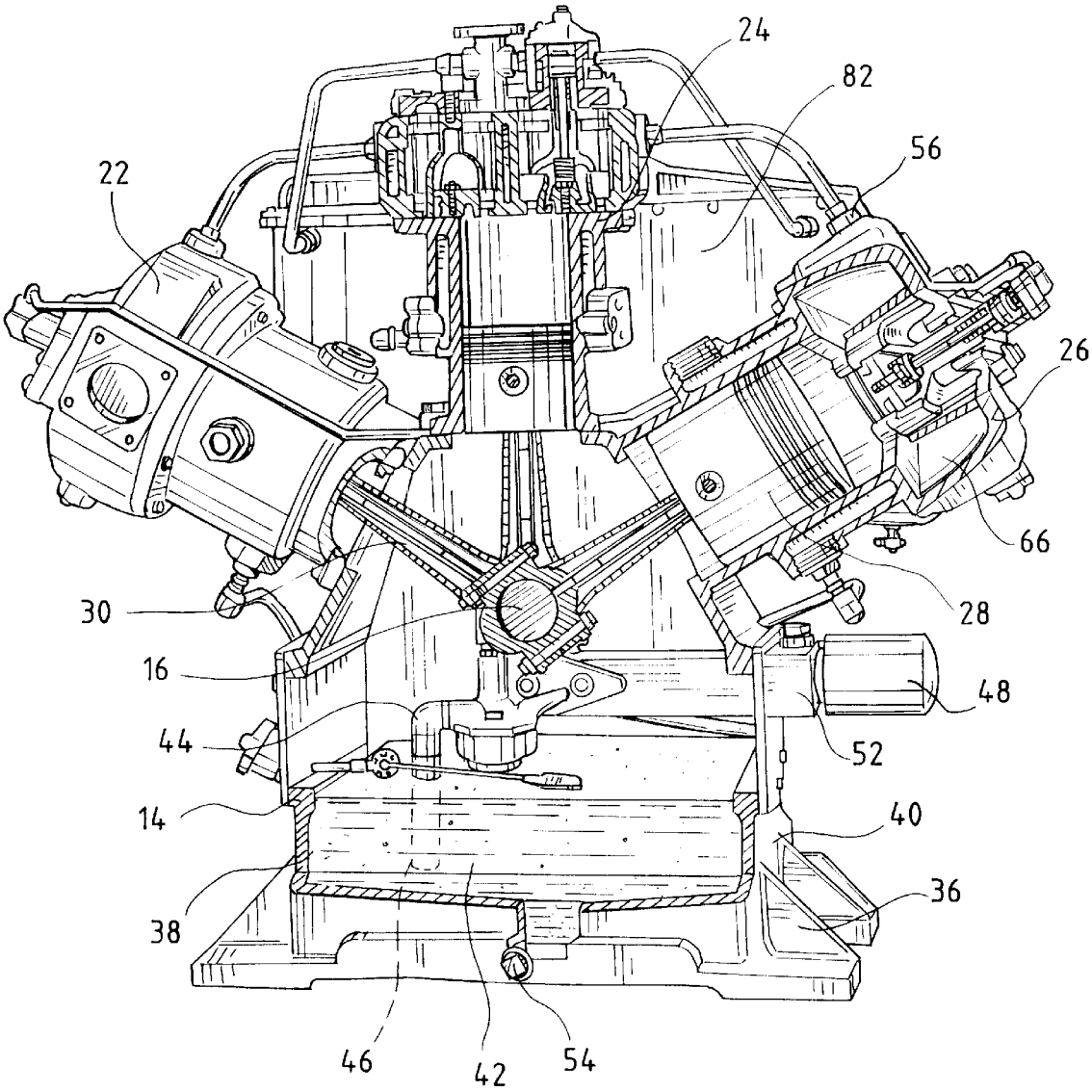
FIG. 3 is a perspective view of the reciprocating locomotive air compressor of the present invention, having portions of the crankcase and cylinders cut away, thus exposing the crank system.

The rear side 62, shown in FIG. 2 includes an opening 63 shown in FIG. 1, for the passage of the crankshaft 16, and also includes the main bearing retainer 31, which houses a crankshaft seal 68 (air cooled only). The main bearing retainer 31 is circular in shape and is adapted to be attached to the crankcase 14 with the use of bolts 70. The main bearing retainer 31 has an outer surface 74. The inner surface 72 is designed to contact the first main bearing 18 to retain it in place. The bearing retainer 31 includes a central aperture 76 to allow for the crankshaft 16 to pass through. The bearing retainer 31 also includes an annular recess 78 that is adapted to accept the cover 33. The crankshaft 16 extends outwardly from the bearing retainer 31 (not shown) to allow for the attachment of a fan blade (not shown) used to cool a radiator type intercooler (not shown), which provides interstage cooling. For water-cooled units a cast iron intercooler 82, shown in FIG. 3 is used. The first main bearing 18 is a large tapered roller bearing and is used to support the rotating crankshaft 16 to prevent unwanted crankshaft 16 deflections.

Figure 1A:
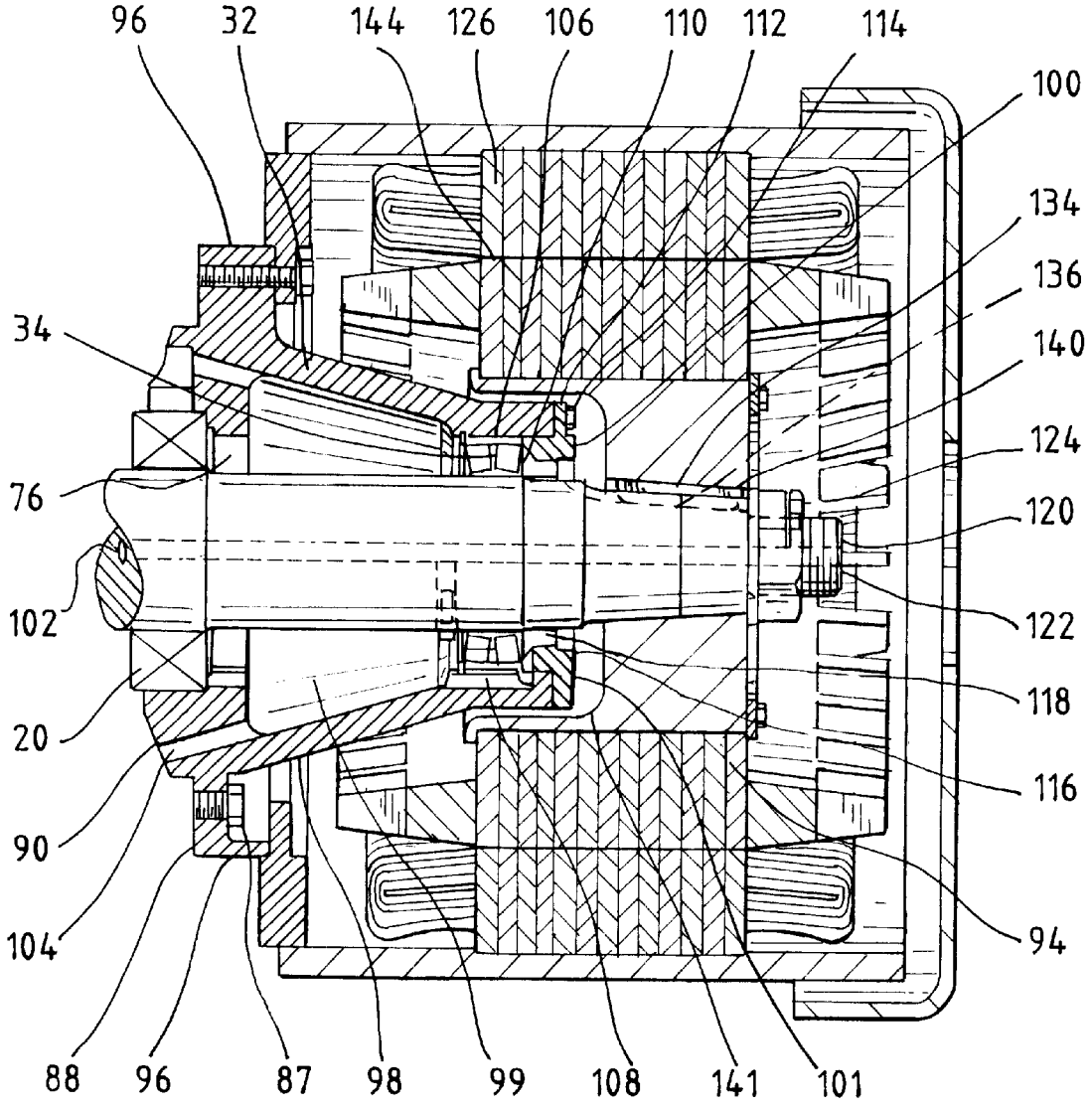
FIG. 1A is an enlarged view of FIG. 1, showing in greater detail, the extended bearing housing and motor.

The front side 60, shown in FIG. 1, includes an opening 84 for the passage of the crankshaft 16. The crankshaft 16 extends outwardly from the crankcase 14 and through the extended bearing housing 32. The front side 60 is adapted to allow for the attachment of the extended bearing housing 32 by providing a plurality of threaded apertures 86. The threaded apertures 86 are aligned with apertures 88 in the extended housing 32 to allow for fasteners 87 such as bolts to pass through and threadably engage with the crankcase 14. The opening 84 is large enough to allow for the seating of the second main bearing 20 which is also a large tapered roller bearing. Either main bearing 18 and 20 may be substituted with a spherical roller, cylindrical roller, or ball bearing if so desired. The second main bearing 20 is retained by an annular recess 90, shown in FIG. 1A, in the extended bearing housing 32.

The extended bearing housing 32, shown in FIG. 1, is mounted to the front side 60 of the crankcase 14 and is designed to eliminate deflections in the crankshaft 16. The extended bearing housing 32 is also designed to allow removal of the crankshaft bearing 34 and the second main bearing 20 without the complete disassembly of the compressor. The extending bearing housing 32 provides for a more rigid support structure for a rotor 94 of the electric motor 12. By reducing the overhung crankshaft 16 extension, the amount of crankshaft deflection is eliminated. Furthermore, the side load created by the unbalanced magnetic pull created by the electric motor 12 is transferred to the extended bearing housing 32. The extended bearing housing has a flange 96, shown in FIG. 1A, a tapered housing 98, a central bore 99, and a crankshaft bearing retainer 100. The flange 96 includes the central aperture 76 to allow for the passage of the crankshaft 16 and includes the annular recess 90 to retain the position of the second main bearing 20. The crankshaft 16 also includes an oil inlet passageway 102 to allow for pressurized lubrication to flow to the crankshaft bearing 34. The flange 96 also includes an oil drain passageway 104 to allow the lubricating oil to drain back into the crankcase 14. The flange 96 further includes the apertures 88 to allow the passage of fasteners 87 to attach the extended bearing housing 32 to the crankcase 14. The tapered housing 98, tapers inward from the flange 96 and includes a recess 106 which is adapted to accept the placement of the crankshaft bearing 34. The recess 106 also includes an oil passageway 108 to allow lubricating oil that has accumulated on the front side 110 of the bearing 34 to drain back towards the crankcase 14. The bearing is retained by using the crankshaft bearing retainer 100. The tapered housing 98 further includes threaded apertures 112 to allow bolts 114 to retain the bearing retainer 100. The bearing retainer 100 is circular in shape and has an inside surface 116 that is adapted to receive an oil seal 118 to prevent the loss of lubricating oil. The crankshaft 16, as it exits the bearing retainer 100, tapers slightly to a smaller radius. The end 120 of the crankshaft 16 contains a plurality of threads 122 that are adapted to receive a locknut 124.

The electric motor 12, shown in FIG. 1, which is used to rotate the crankshaft 16 includes a stator core 126, a stator winding 128, the rotor 94 and a housing 132. The rotor 94, which is cylindrical in shape, includes a center aperture 134 to allow the rotor to be inserted onto the crankshaft 16. The rotor 94, shown in FIG. 1A, and the crankshaft 16 include key ways 136 to provide locking engagement with the aid of a key 140. The rotor 94 also includes an annular recess 141 to allow the rotor to be positioned over the tapered end 98 of the extended bearing housing 32, which orients the centerline of the rotor 94 equal with the outer edge 101 of the crankshaft bearing retainer 100. The rotor 94 is fastened to the crankshaft 16 by using the lock nut 124. The stator core 126, shown in FIG. 1, which surrounds the rotor 94, is positioned so that a small air gap 144 is created. A smaller air gap 144 is desirable because the magnetic force created by the stator core 126 that is used to rotate the rotor 94 is more efficient at closer tolerances. The extended bearing housing 32, shown in FIG. 1, in combination with the crankshaft bearing 34 eliminates defections in the crankshaft 16. Since there is no deflection in the crankshaft 16, it is possible to reduce the size of the air gap 144 to increase the efficiency by using more precision motors 12. The housing 132 of the electric motor 12 is adapted to encapsulate the extended bearing housing 32 and couple to the flange 96.

The locomotive air compressor 10 with the outboard support bearing 34 creates a reduction in the amount of unsupported crankshaft 16 overhang between the compressor 10 and the electric motor 12, providing a more rigid support structure for the rotor 94. The extended bearing housing 32 encloses the extended crankshaft 16 and stabilizes it with the third bearing 34. Since the extended bearing housing 32 is removable from the crankcase 14, the second main bearing 20 can be serviced without the disassembly of the entire compressor 10. Also, since the extended bearing housing 32 is integrated into the crankcase 14, lubrication can be supplied to the third bearing 34 by the oil pump 44 shown in FIG. 3.

Figure 4:
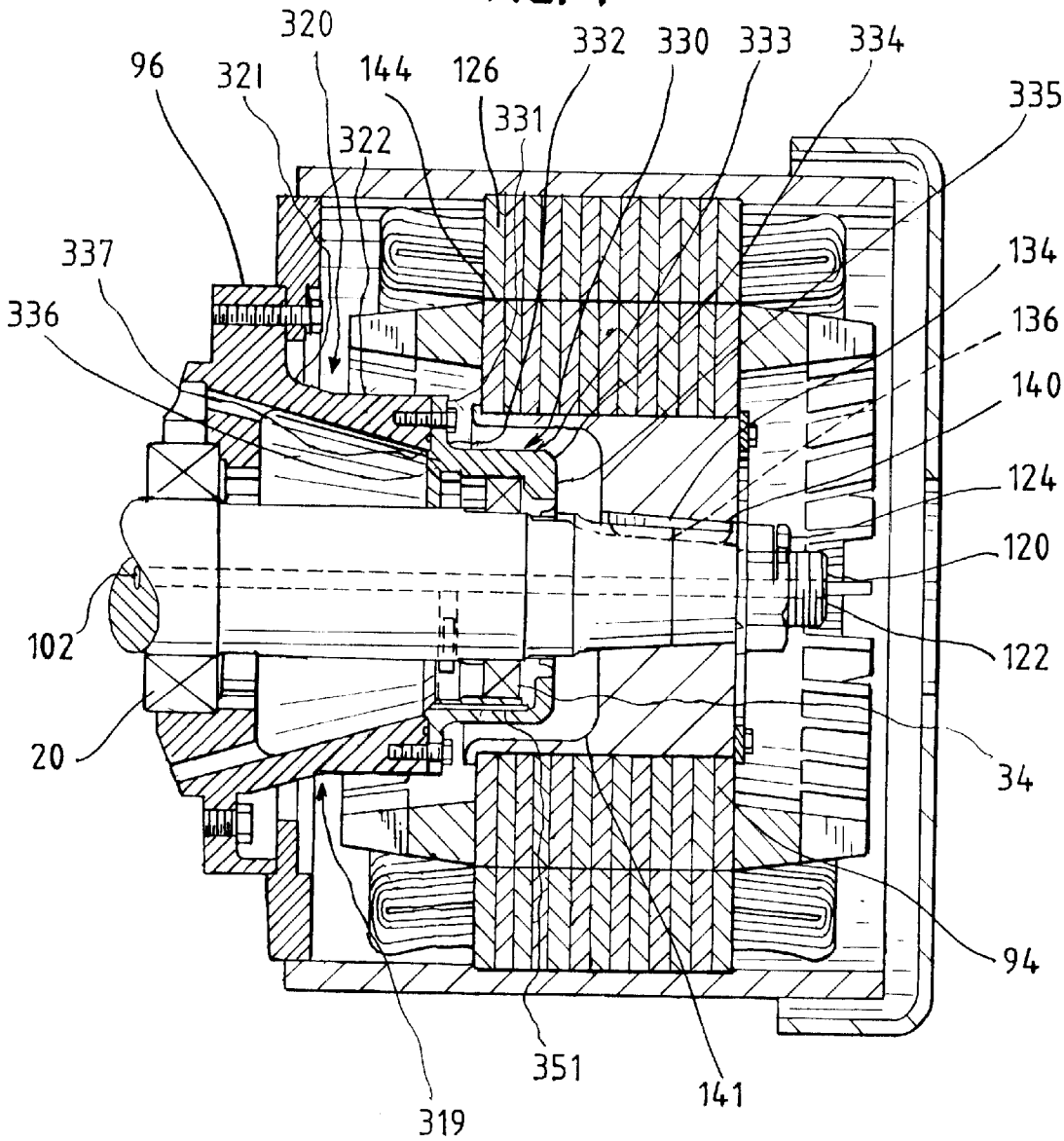
FIG. 4 is an enlarged view of an alternative embodiment of the bearing housing shown in FIG. 1.

Now referring to FIG. 4, an alternative embodiment of bearing housing 32 is depicted. The alternative bearing housing 319 has a different structure than bearing housing 32. The differences between bearing housing 319 and bearing 32 are readily apparent by comparison of FIG. 4 to FIG. 1*a*.

A review of FIG. 4 shows that bearing housing 319 has a crank case mounted portion 320 and an outboard bearing support portion 330. The outboard bearing support portion 330 is coupled by way of bolts to the crank case mounted portion 320. The crank case mounting portion 320 of bearing housing 319 has a frustoconical interior surface opposite its exterior surface. The exterior surface includes a first surface portion 321 which is oriented relative to the crank shaft at a first angle. The exterior surface includes a second portion 322 oriented relative to the crank shaft at a second angle. The second angle is 180 degrees. The first angle is between 20 and 25 degrees.

The outboard bearing support portion 330 has an interior cylindrical surface concentric to the shaft. The outboard bearing support portion 330 houses support bearing 34.

The portion 330 includes a first perpendicular portion 331, perpendicular to the crank shaft; a parallel portion 333, parallel to the crank shaft and a second perpendicular portion 335, perpendicular to the crank shaft. The parallel portion 333 is between the two perpendicular portions. The first perpendicular portion 331 has a crank case facing surface 334 which abuts up against a motor facing surface of mounted portion 320. The first perpendicular portion 331, parallel portion 333 and second perpendicular portion 335 from a truncated portion of bearing housing 319.

An o-ring 350 seals the surfaces with the aid of bolts. The housing portion 330 has an interior conical shoulder 336 to provide an interior annular support 337 to assist in coupling the first bearing housing portion 320 to second bearing housing portion 330.

In the other embodiment, bearing housing 32 included bearing retainer 100 Bearing retainer 100 formed an end cap of bearing housing 32 to facilitate retention of bearing 34. In contrast, the alternative embodiment, bearing housing 319, facilitates the changing of bearing 34 by forming bearing housing 319 from a first portion 320 and a second portion 330, both portions being joined midway along the length of the bearing housing.

Various features of the invention have been particularly shown and described in connection with the illustrated embodiment of the invention; however, it must be understood that these particular arrangements merely illustrate, and that the invention is to be given its fullest interpretation within the terms of the appended claims.

We claim:

1. A bearing housing for a locomotive air compressor comprising:

a first end adapted for removable coupling to a compressor crankcase;

a second end, opposite said first end, and laterally displaced therefrom;

a central bore extending through said bearing housing adapted to receive a crankshaft extending therethrough;

an annular recess formed in said second end, concentric with said central bore adapted to receive a bearing;

a first portion, said first portion having said first end;

a second portion, said second portion having said second end, said first and second portion removably coupled to each other between said first end and said second end, said annular recess in said second portion;

whereby said bearing housing provides for additional support of said crankshaft to prevent crankshaft deflection.

2. The bearing housing of claim 1 further comprising:

a first member forming a portion of said second portion;

an adjacent member adjacent to said first member, said adjacent member at an angle relative to said first member, said adjacent member a part of said second portion.

3. The bearing housing of claim 2 wherein said annular recess is formed in said adjacent member.

4. The bearing housing of claim 3 further comprising:

a second member forming a portion of said second portion, said second member at an angle with said adjacent member said adjacent member separating said first member from said second member.

5. The bearing housing of claim 4 wherein said first member couples to said first portion.

6. The bearing housing at claim 5 wherein the second member provides lateral support to said bearing when said bearing housing is assembled to said locomotive compressor.

7. A locomotive air compressor comprising:

a crankcase adapted to support a crankshaft;

a bearing housing removably attached to said crankcase, and adapted to support said crankshaft;

an electric motor;

said bearing housing having a first portion and a second portion, said first portion is removably coupled to said second portion between said first and second end, said first portion having a first end, said bearing housing attached to said crank case at said first end;

said bearing housing having an annular recess adapted to receive a bearing, said annular recess formed in said second portion.

* * * * *